United States Patent [19]

Hennings et al.

[11] Patent Number: 4,489,656

[45] Date of Patent: Dec. 25, 1984

[54] PENETRATING ORDNANCE SAFE AND ARMING MECHANISM

[75] Inventors: George N. Hennings; Richmond H. Nickles; Larry F. Brauer; Raymond H. DeHarrold, all of Ridgecrest, Calif.

[73] Assignee: The United States of America as represented by the Secretary of the Navy, Washington, D.C.

[21] Appl. No.: 468,422

[22] Filed: Feb. 22, 1983

[51] Int. Cl.[3] ..... F42C 15/34; F42C 15/40

[52] U.S. Cl. ..... 102/254; 102/262

[58] Field of Search ..... 102/254, 255, 262, 264, 102/221, 222

[56] References Cited

U.S. PATENT DOCUMENTS

| | | | |
|---|---|---|---|
| 2,773,449 | 12/1956 | Karsberg | 102/254 |
| 3,207,075 | 9/1965 | Semenoff | 102/254 |
| 3,417,701 | 12/1968 | Bodinaux | 102/255 |
| 3,618,527 | 11/1971 | Kilmer | 102/254 |
| 3,908,553 | 9/1975 | Beach | 102/254 |
| 4,007,689 | 2/1977 | Apotheloz | 102/255 X |
| 4,036,144 | 7/1977 | Meek | 102/254 |
| 4,046,076 | 9/1977 | Hampton | 102/262 X |
| 4,078,496 | 3/1978 | Kruger | 102/255 X |
| 4,144,816 | 3/1979 | Beuchat | 102/254 X |
| 4,155,306 | 5/1979 | Herold et al. | 102/254 X |
| 4,220,091 | 9/1980 | Israels | 102/255 X |
| 4,240,351 | 12/1980 | San Miguel | 102/254 X |

*Primary Examiner*—David H. Brown

*Attorney, Agent, or Firm*—Robert F. Beers; W. Thom Skeer

[57] ABSTRACT

A test operable electro-mechanical safe and arming mechanism for hardened target penetrating, and other, ordnance, not relying on stored energy, incorporating two mechanical interlocks and providing an electro-mechanical elapsed time reference and mechanical logic to check external control apparatus operation comprises a body having a reversible motor which drives a rotatable shaft having ends threaded in opposite directions. The shaft penetrates the threaded holes of three members which move axially depending on the direction of shaft rotation. The middle member is an initially misaligned explosive train component configured to engage one threaded shaft end to advance into the aligned or armed position. A ball interlock maintains this component misaligned until ordnance delivery is sensed at which time motor energization occurs in a first direction to cause shaft rotation and to preposition the mechanism for arming. Subsequent motor energization causes shaft rotation in the opposite direction which allows the misaligned member to engage one threaded shaft end and advance to the armed position. The shaft threads block this member's advance until the member is pushed against and engages the threads which must be cooperatively rotating. A spring arrangement which is prepositioned by the initial motor energization provides the force to cause the engagement of the member and the threads.

8 Claims, 6 Drawing Figures

10
11
13
14
17
21
22
26
27
28
29
30
39
40
41
43
44
45
46
47
48
49
50
51
52
54
55
56
57
58
59
60
61
63
64
65
66

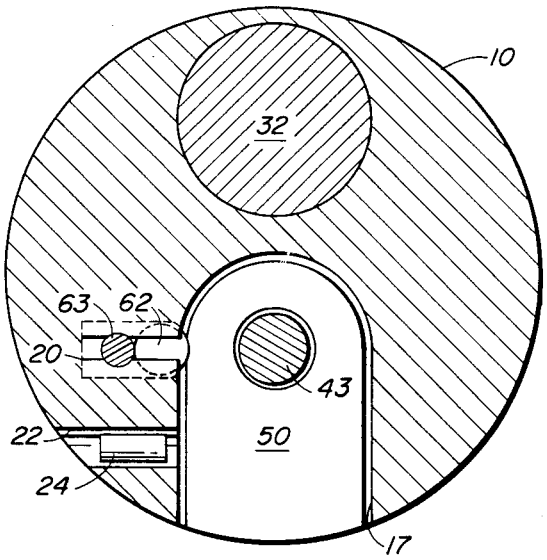
Fig. 3
Fig. 4
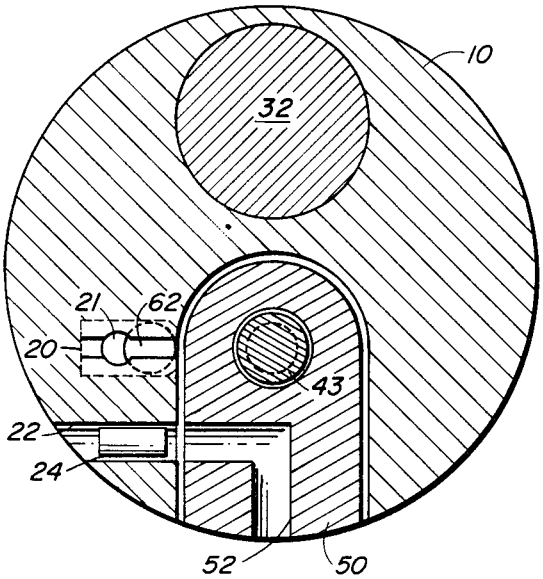

PENETRATING ORDNANCE SAFE AND ARMING MECHANISM

BACKGROUND OF THE INVENTION

1. Field of the Invention

This invention pertains to munitions and more specifically to safe and arming mechanisms utilized in aircraft delivered ordnance.

One of the critical elements in conventional ordnance is the safe and arming mechanism the function of which is to maintain the ordnance in a safe condition until proper inputs are received to initiate the arming sequence. Receipt of proper inputs results in the transformation of the safe and arming mechanism into a configuration in which the main explosive charge can be detonated. One basic concept common in safe and arming technology rests in the interruption of the explosive train by imposition of a movable barrier between explosive train components. This concept is rapidly losing favor to the other, and currently more accepted, basic safe and arming concept involving the misalignment and subsequent alignment of explosive train components. That is, in the safe condition primary initiation explosives located within the safe and arming mechanism are maintained misaligned with the ordnance booster and warhead explosives. Transformation from the safe to the armed condition is accomplished by the controlled alignment of the initially misaligned primary initiation explosives, located within the safe and arming mechanism, with the ordnance booster and warhead explosives.

In aircraft applications the arming process is initiated when a unique set of input signals is received within the ordnance indicating its release from the delivering aircraft. Arming ideally occurs after the ordnance has achieved safe separation from the aircraft which is a function of time/distance. Once arming has occurred detonation of the primary initiation explosives within the safe and arming mechanism will cause booster/warhead detonation. Explosive effects resulting from initiation of the primary explosives, while the mechanism is in the safe condition, will be contained within the mechanism and will not be communicated to the booster/warhead so as to cause their detonation.

2. Description of the Prior Art

As noted, experience has caused barrier movement safe and arming configurations to be relegated to secondary status as compared to the use of misalignment/alignment type configurations. This is due to the fact that barrier movement configurations present additional design difficulties, particularly with respect to the barrier itself, while presenting no particular advantages over the use of misalignment/alignment configurations.

Current art safe and arming mechanisms utilize either mechanical escapements or electronic timers to provide safe separation arming delays. Further, many mechanisms incorporate or rely upon stored energy for component movement or alignment power. The use of mechanical escapements is undesirable, first, because escapement technology and manufacturing capability is disappearing with the advent of digital watch technology, second, mechanical escapement flexibility is poor resulting in relatively poor timing accuracy and, third, mechanical escapements are capable of malfunctioning in a "runaway" mode resulting in premature arming.

While electronic timers are extremely accurate, they are susceptible to the "runaway" failure mode to a degree greater than mechanical escapements. Further, existing safe and arming mechanisms do not incorporate reliable mechanical interlocks in conjunction with the use of electronic timers. This is particularly hazardous in applications where stored energy is relied upon to implement arming and the lack of a satisfactory mechanical interlock can result in unwanted arming due to the inadvertent release of the stored energy and the bypassing of the electronic timer entirely. Current art stored energy devices generally utilize stored mechanical or chemical energy. Such devices are often "single shot" devices, incapable of repeated cycling or testing, which results in unacceptably high failure rates both in the failure to arm or "dud" mode and in the inadvertent or premature arming mode.

Another deficiency in current art safe and arming mechanisms is exposed by their usage in hardened target penetrating ordnance. In this type of application the mechanism is relied upon to survive impact and the high accelerations attendant therewith in an armed and operable condition so that warhead detonation can be delayed until penetration of the target has been achieved. Current safe and arming mechanisms display an unacceptably high dud rate in this type of application exhibiting a tendency to be destroyed on impact, in which case the warhead detonation process fails to be initiated entirely, or to severely deform, in which case warhead detonation fails to occur even if the initiation explosives function properly. The high dud rate is based upon the failure of existing technology to establish a safe and arming mechanism configuration capable of withstanding high impacts in a condition in which warhead detonations can reliably be expected to occur.

SUMMARY OF THE INVENTION

The present invention relates to a safe and arming mechanism, based upon the explosive train misalignment/alignment concept, for aircraft delivered ordnance requiring a time delay prior to arming to ensure safe separation of armed ordnance from the delivering aircraft. It further relates to a safe and arming mechanism configured to survive, in an armed and operable condition, the high accelerations experienced in hardened target penetrating ordnance applications. The present invention utilizes two positive mechanical interlocks, a gag rod and ball and a reversible threaded shaft, in conjunction with a reversing motor, to accomplish arming while preventing its premature occurrence. These interlocks can be overcome only by the proper and timely electro-mechanical operation of this invention. The mechanism provides an electro-mechanical time reference to be utilized as a check on external control logic in a configuration which provides for the survivability of the mechanism in an armed and operable condition after impact with and penetration of a hardened target. The present invention if capable of repeated test arming and resafing prior to installation in "live" ordnance and does not rely on stored energy to accomplish arming.

An object of the present invention is to provide a safe and arming mechanism containing an electro-mechanical timing reference against which a decision may be made by logic apparatus located within the ordnance, external to the safe and arming mechanism, whether the arming sequence has progressed properly and should be allowed to proceed to completion.

Another object of the present invention is to provide an electro-mechanical safe and arming mechanism which internally incorporates mechanical logic as a check on the operation of a control device external to it.

Another object of the present invention is to provide an electro-mechanical safe and arming mechanism which neither contains nor relies upon stored energy for operative power.

Another object of the present invention is to provide an electro-mechanical safe and arming mechanism which may be repeatedly test armed and resafed.

A further object of the present invention is to provide an electro-mechanical safe and arming mechanism, for use within hardened target penetrating ordnance, configured to withstand high acceleration impacts with and the penetration of hardened targets in an armed and operable condition in which warhead detonation can reliably be expected to occur.

DESCRIPTION OF THE DRAWINGS

For a better understanding of the present invention, together with other and further objects thereof, reference is made to the following descriptions taken in connection with the accompanying drawings wherein:

FIG. 3 is a transverse section view taken along line 3—3 of FIG. 2 axially bisecting the detonator bore when the mechanism is in a fully safed condition;

FIG. 4 is a transverse section view taken along the same line as in FIG. 3 except that the mechanism is now shown in a fully armed condition (note also that line 3—3 of FIG. 2 demonstrates only a cutting plane location and that FIGS. 3 and 4 are not sectional views of the section view shown in FIG. 2 but are full transverse section views of the assembled mechanism);

DESCRIPTION OF THE PREFERRED EMBODIMENTS

Figure 1:
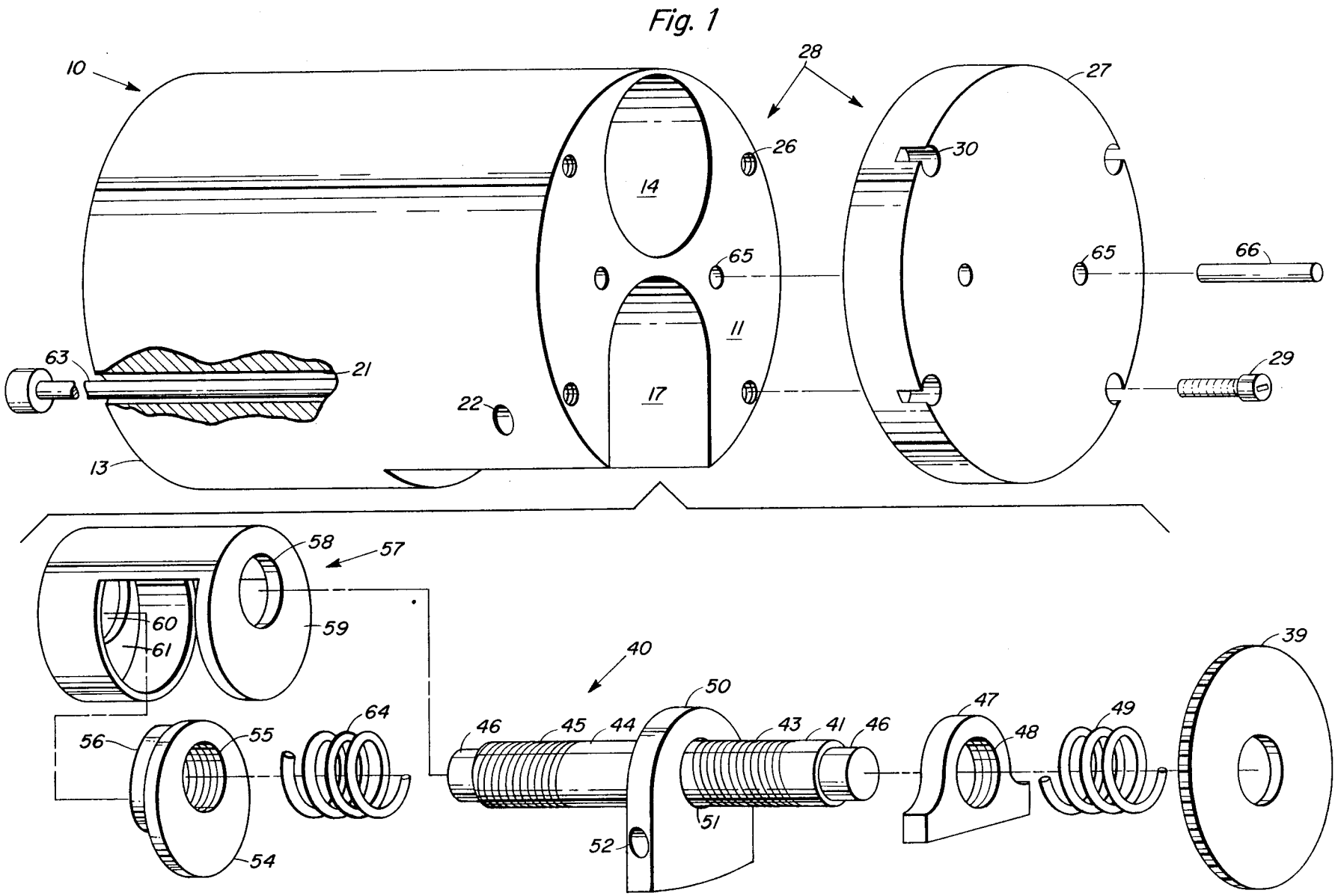
FIG. 1 is an exploded isometric view of major components making up a safe and arming mechanism embodying the present invention.
Figure 2:
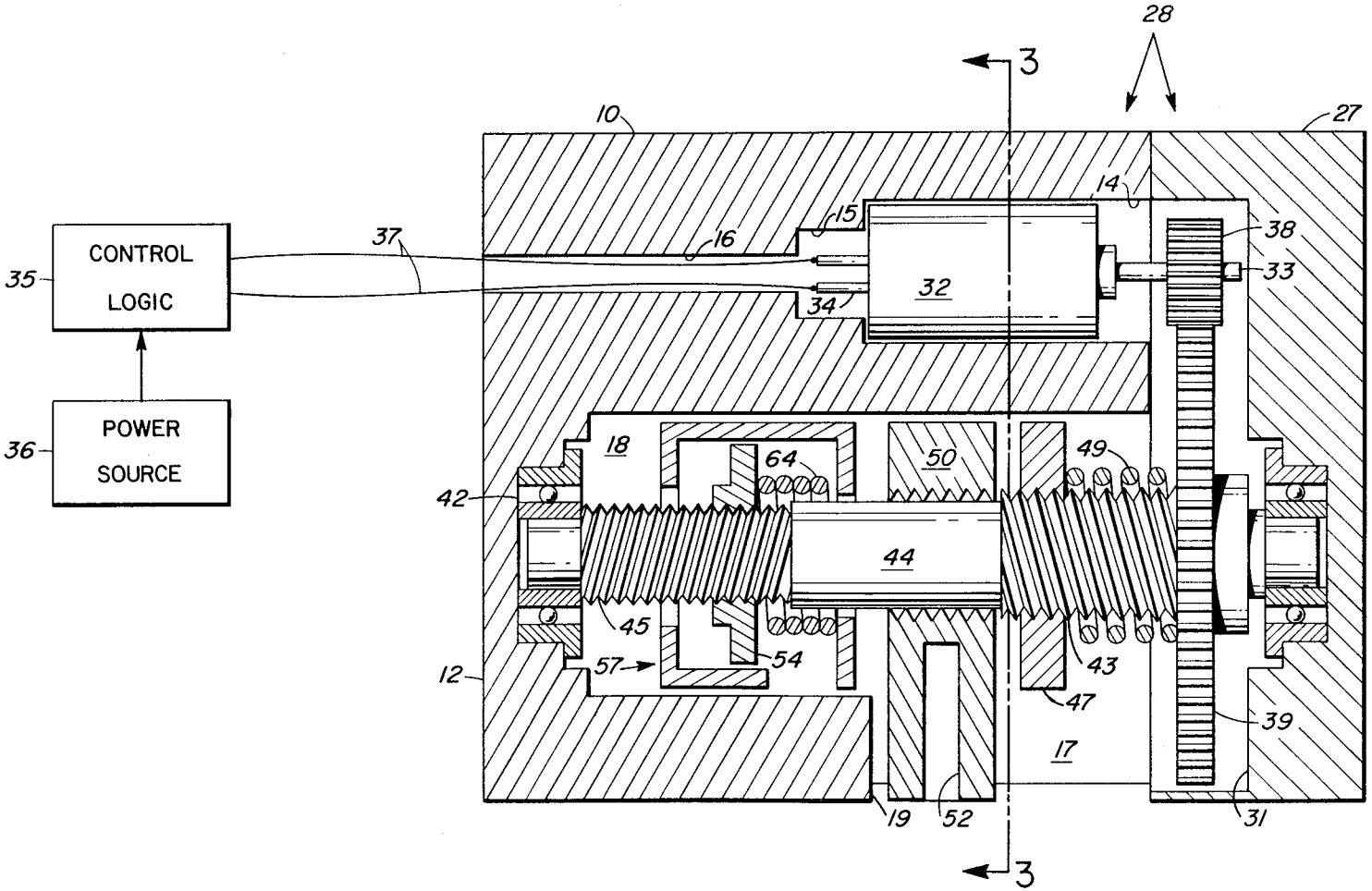
FIG. 2 is a longitudinal section view of the assembled mechanism.

FIGS. 1 through 6 illustrate a safe and arming mechanism embodying an example of the present invention. Referring generally to FIGS. 1 and 2, cylindrical housing member 10 includes a front face 11, a back face 12 and an exterior 13. Housing member 10 defines a longitudinal motor housing cavity 14, which communicates with front face 11, and a motor terminal housing cavity 15 which is concentric and communicates with motor terminal housing cavity 14. Motor lead passage 16 connects motor terminal housing cavity 15 with back face 12 of housing member 10. Housing member 10 further defines a longitudinal arming notch 17 which runs parallel to and diametrically opposite motor housing cavity 14 and which communicates with exterior 13 and front face 11. Arming notch 17 includes recess 18 and is configured to form lip 19 in housing member 10.

Figure 5:
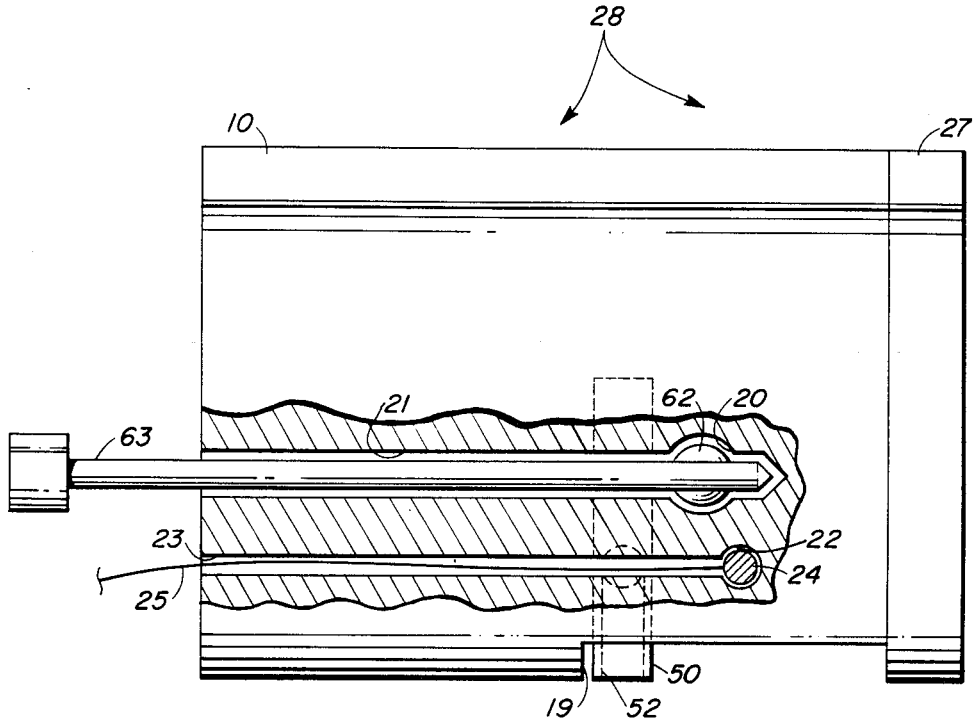
FIG. 5 is a longitudinal breakaway view exposing the gag rod/gag rod bore and detonator lead passage details when the mechanism is in a fully safed condition.

Referring now to FIGS. 3 and 5, transverse ball chamber 20, defined by housing member 10, communicates with arming notch 17 and a longitudinal gag rod bore 21 which is also defined by housing member 10. Gag rod bore 21 has a diameter less than that of ball chamber 20 and connects back face 12 with ball chamber 20. Housing member 10 defines transverse detonator bore 22, which communicates with exterior 13 and arming notch 17. Housing member 10 further defines detonator lead passage 23 which is a longitudinal passage connecting detonator bore 22 with back face 12. Detonator 24 is fixedly mounted within detonator bore 22 and is initiated by an external electrical signal communicated to it by detonator leads located within detonator lead passage 23.

Referring once again to FIGS. 1 and 2, housing member 10 defines longitudinal threaded fastener holes 26 located in front face 11. Cylindrical end plate 27 is attached to housing member 10 at front face 11 and results in the formation of cylindrical safe and arming housing body 28. Threaded fasteners 29 disposed in countersunk fastener bores 30 attach end plate 27 to housing member 10. Alignment pin boreholes 65 are bored into arming housing body 28 through end plate 27 and into housing member 10. Alignment pins 66 are inserted into alignment pin boreholes 65 to facilitate the precise alignment of end plate 27 with housing member 10. End plate 27 defines a drive train cavity 31 which communicates with arming notch 17 and motor housing cavity 14 in housing member 10.

Fixedly mounted within motor housing cavity 14 is reversing motor 32 which has an output shaft 33 oriented toward and extending into drive train cavity 31 of end plate 27. Power terminals 34 of reversing motor 32 are connected to external control logic 35 and external power source 36 by leads 37 located in motorlead passage 16.

First rotatable gear 38 is fixedly mounted on output shaft 33 of reversing motor 32 and meshingly engages a second rotatable gear 39 in drive train cavity 31 of end plate 27. Second rotatable gear 39 is fixedly mounted on an arming shaft 40 at seating surface 41. Arming shaft 40 is longitudinally aligned and rotatably mounted in bearings 42 in safe and arming housing body 28. Referring to FIG. 1, arming shaft 40 has a right-hand threaded front portion 43, an unthreaded central portion 44, and a left-hand threaded back portion 45 in addition to seating surface 41 and mounting surfaces 46. A timing member 47 defining an eccentric right-hand threaded hole 48 is in threaded engagement with right-hand threaded front portion 43 of arming shaft 40 and is slidably disposed within arming notch 17 of housing member 10. Timing member 47, by its irregular shape and slidable disposition in arming notch 17, is prevented from rotation with arming shaft 40 and is constrained to travel axially along right-hand threaded front portion 43. A first helical compression spring 49 is penetrated by arming shaft 40 and is interposed between timing member 47 and second rotatable gear 39.

Explosive lead member 50 defining eccentric right-hand threaded hole 51 is slidably mounted on unthreaded central portion 44 of arming shaft 40 and is slidably disposed in arming notch 17 of housing member 10. Eccentric right-hand threaded hole 51 is configured to engage right-hand threaded front portion 43 of arming shaft 40. Explosive lead member 50, by its irregular shape and slidable disposition in arming notch 17, is prevented from rotation with and is constrained to travel axially along arming shaft 40. Lip 19 of housing member 10 prevents explosive lead member 50 from entering recess 18 of arming notch 17. Explosive lead member 50 defines open-ended explosive lead passage 52 one end of which is selectively located so as to be positionable adjacent detonator 24 when the mechanism is armed. (See FIGS. 2 and 3).

An arming block 54 defining an eccentric left-hand threaded hole 55 and having a protruberance 56 is engaged on left-hand threaded back portion 45 of arming shaft 40 and is slidably disposed within a hollow slotted spring containment 57. Spring containment 57 defines an eccentric front hole 58 in its front plate 59 and an eccentric back hole 60 in its back plate 61. Front hole 58 and back hole 60 are penetrated by arming shaft 40. Protruberance 56 of arming block 54 fits slidingly into back hole 60 of spring containment 57. A second helical compression spring 64 is penetrated by arming shaft 40 and is interposed between arming block 54 and front plate 59 within spring containment 57. Spring containment 57 is slidably disposed in recess 18 of arming notch 17. Second helical compression spring 64 is configured to be in some degree compressed at all times between arming block 54 and front plate 59 of spring containment 57.

Referring to FIGS. 3 and 5, interlock ball 62 is rollably disposed and retained in ball chamber 20 of housing member 10. Cylindrical gag rod 63 is slidably disposed in gag rod bore 21 and protrudes out of back face 12 of housing member 10 (see FIG. 1 for further clarification).

Referring to FIGS. 3 and 5, in operation, gag rod 63 is held fully inserted in gag rod bore 21 by means external to safe and arming housing body 28. When fully inserted into gag rod bore 21, gag rod 63 penetrates ball chamber 20 and pins interlock ball 62 in a position partially protruding into arming notch 17. Protrusion of interlock ball 62 into arming notch 17 locks explosive lead member 50 on unthreaded central portion 44 of arming shaft 40 between interlock ball 62 and lip 19 of housing member 10. This blocks any axial movement of explosive lead member 50 within arming notch 17 and maintains explosive lead member 50 in the safe position on unthreaded central portion 44 of arming shaft 40 misaligned with detonator bore 22.

Figure 6:
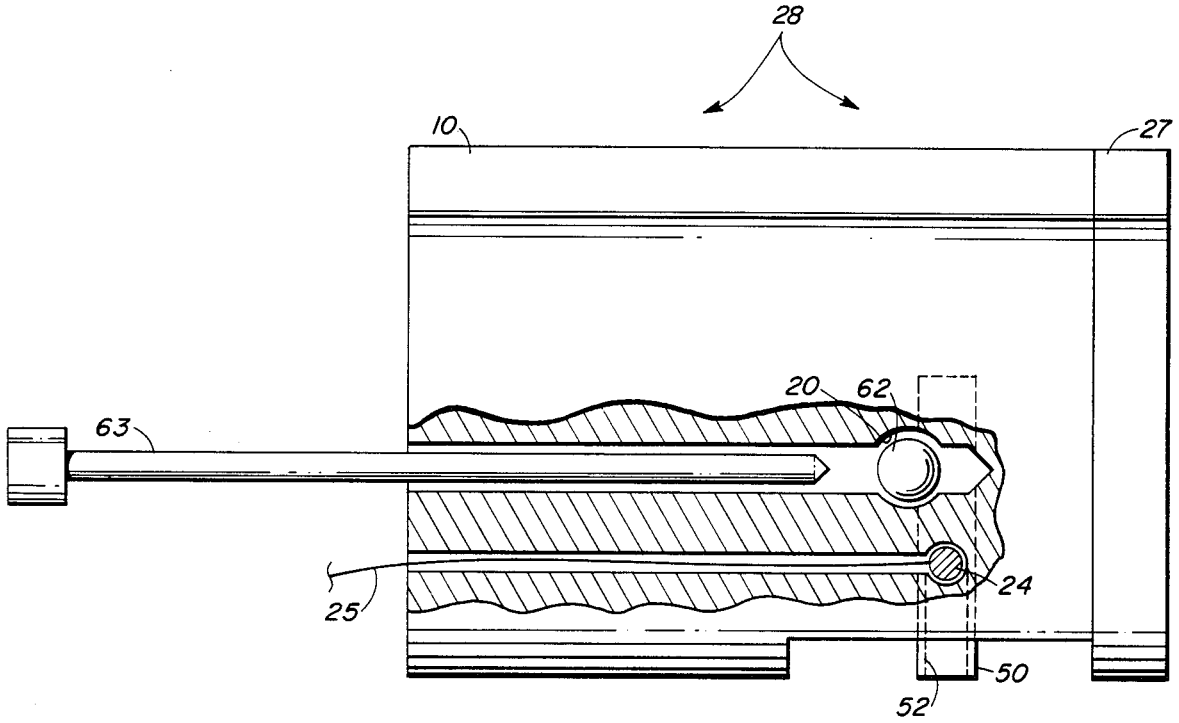
FIG. 6 is a breakaway; view exposing the same view as FIG. 5 with the exception that the mechanism is represented in a fully armed condition.

Referring now to FIGS. 4 and 6, release of the ordnance from the delivering aircraft generates a release signal and causes gag rod 63 to be partially withdrawn out of gag rod bore 21 which enables interlock ball 62 to move within ball chamber 20. The unpinning of interlock ball 62 frees explosive lead member 50 for axial movement along arming shaft 40 in arming notch 17 toward front face 11 of housing member 10. Interlock ball 62 and gag rod 63 are a first interlock which must be overcome before explosive lead member 50 can move axially within arming notch 17 to the armed position.

Referring now to FIG. 2, as well as causing the partial withdrawal of gag rod 63 out of gag rod bore 21, release of the ordnance from the delivering aircraft is sensed by external control logic 35 which causes an electronic timer within the control logic 35 to start running. After a predetermined interval elapses, as determined by the electronic timer within it, external control logic 35 causes power to be supplied to energize reversing motor 32. Initial energization of reversing motor 32, in this embodiment, causes output shaft 33, to rotate in a clockwise direction and results in the counterclockwise rotation of arming shaft 40. The counterclockwise rotation of arming shaft 40 causes arming block 54 and timing member 47, which are initially located at the ends of their respective threaded portions of arming shaft 40 furthest from unthreaded central portion 44, to converge toward unthreaded central portion 44 upon which explosive lead member 50 is positioned. (See FIG. 1 for arming shaft details). The axial movement of arming block 54 toward explosive lead member 50 results in the transmission of force through second helical compression spring 64 to front plate 59 of spring containment 57 and causes spring containment 57 to slide axially in recess 18 of arming notch 17 in cooperation with arming block 54. Front plate 59 of spring containment 57 ultimately moves into contact with explosive lead member 50 causing explosive lead member 50 to be pushed along unthreaded central portion 44 of arming shaft 40 away from lip 19 of housing member 10 toward right-hand threaded front portion 43. Due to the thread direction of right-hand threaded hole 51 of explosive lead member 50 and the counterclockwise rotation of arming shaft 40, explosive lead member 50 is unable to engage right-hand threaded front portion 43 of arming shaft 40 when forced against it by the transmitted axial movement of arming block 54. The uncooperatively rotating threads of right-hand threaded front portion 43 act as a second mechanical interlock which must be overcome before explosive lead member 50 can move into the armed position, in alignment with detonator bore 22. It is to be noted that spring containment 57 is useful to maintain second helical compression spring 64 under some degree of compression at all times to prevent the possibility of in-flight vibratory damage.

Uncooperatively rotating right-hand threaded front portion 43 of arming shaft 40 which stops the axial movement of explosive lead member 50, also limits further axial movement of spring containment 57 under the influence of arming block 54 by virtue of the abutment of spring containment 57 against explosive lead member 50. This results in the increased compression of second helical compression spring 64 as arming block 54 continues to advance axially within spring containment 57 along left-hand threaded back portion 45 of arming shaft 40.

As noted, initial counterclockwise rotation of arming shaft 40, in addition to causing the axial movement of arming block 54, also causes timing member 47 to move axially along right-hand threaded front portion 43 of arming shaft 40 toward unthreaded central portion 44. Timing member 47 moves into contact with explosive lead member 50 after explosive lead member 50 has been forced against uncooperatively rotating right-hand threaded front portion 43 by the axial movment of arming block 54. The continued axial advance of timing member 47 after its contact with explosive lead member 50 causes explosive lead member 50 to be pushed away from uncooperatively rotating right-hand threaded front portion 43 of arming shaft 40 back toward lip 19 of housing member 10 and converging arming block 54. The net result of the relative movements of arming block 54, explosive lead member 50 and timing member 47 is to cause second helical compression spring 64 to undergo increased compression. Second helical compression spring 64 is increasingly compressed between converging arming block 54 and timing member 47 until reversing motor 32 becomes incapable of providing sufficient power to cause any further compression of second helical compression spring 64. When unable to cause the further compression of second helical compression spring 64, reversing motor 32 stalls and arming shaft 40 discontinues rotating. Control logic 35 causes power to be disconnected from reversing motor 32 when stalling of the motor is sensed. It is to be noted that at this point in the arming sequence explosive lead member 50 remains on unthreaded central portion 44 of arming shaft 40 in the safe position misaligned with detonator bore 22 and detonator 24.

The initial energization of reversing motor 32, as noted, occurs when an electronic timer within external control logic 35 reaches a predetermined elapsed time after ordnance release to ensure a safe separation distance is achieved between the ordnance and the delivering aircraft prior to commencement of the arming sequence. The elapsed time between initial reversing motor energization and stalling, which is a function of the electro-mechanical operation of the safe and arming mechanism embodiment herein described, is monitored by external control logic 35, providing an electro-mechanical time reference against which the elapsed time of the electronic timer within external control logic 35 may be compared. If the difference between the elapsed time of the electronic timer and the monitored elapsed time between reversing motor energization and stalling falls within a predetermined range, external control logic 35 allows the electronic timer to maintain control over the energization of reversing motor 32 and thus over the remainder of the arming sequence. If the elapsed times do not compare within the allowable range, indicating the possibility of a runaway electronic timer or a malfunction in the electro-mechanical operation of the safe and arming mechanism during the initial energization of reversing motor 32, external control logic 35 aborts electronic timer control of reversing motor 32. This results in the electronic "dudding" of the ordnance due to the resultant stranding of explosive lead member 50 in an unarmed position on unthreaded central portion 44 of arming shaft 40. The configuration of the safe and arming mechanism thus described provides an electro-mechanical time reference to be used as a check on electronic timer control safeguarding against premature ordnance arming due to a runaway electronic timer, or malfunction within the mechanism.

If comparison within external control logic 35 determines that the initial electro-mechanical operation of the safe and arming mechanism and the electronic timer are acceptable as within specified elapsed time parameters, power is resupplied to reversing motor 32 causing the counterclockwise rotation of output shaft 33 and the clockwise rotation of arming shaft 40. This rotation is opposite in direction to the rotation resulting from the original energization of reversing motor 32 and causes arming block 54 and timing member 47 to diverge from unthreaded central portion 44 of arming shaft 40 on which explosive lead member 50 is located. As arming block 54 and timing member 47 diverge, compressed second helical compression spring 64 expands within spring containment 57. Under the impetus of second helical compression spring 64 spring containment 57 pushes explosive lead member 50 against now cooperatively rotating right-hand threaded front portion 43 of arming shaft 40. This results in the threaded engagement of explosive lead member 50 with right-hand threaded front portion 43 of arming shaft 40 and causes explosive lead member 50 to follow timing member 47 in its axial movement away from unthreaded central portion 44. The threaded engagement of explosive lead member 50 with right-hand threaded front portion 43 of arming shaft 40 occurs prior to the movement of arming block 54 into back hole 60 of back plate 61 of spring containment 57 as arming block 54 diverges from unthreaded central portion 44 of arming shaft 40. When arming block 54 does move into back hole 60 of spring containment 57 the result is the movement of second helical compression spring 64 and spring containment 57 away from unthreaded central portion 44 of arming shaft 40 under the influence of arming block 54.

As timing member 47 approaches second gear 39, in its divergence from unthreaded central portion 44 of arming shaft 40, first nelical compression spring 49 is increasingly compressed. When first helical compression spring 49 becomes fully compressed, timing member 47 becomes incapable of further axial movement towards second gear 39 preventing further clockwise rotation of arming shaft 40. The inability of arming shaft 40 to be further rotated in a clockwise direction acts as a complete brake on reversing motor 32 causing it to stall. The second stalling of reversing motor 32 is sensed by electronic control logic 35 which causes power to be disconnected from motor 32.

At the point arming shaft 40 becomes incapable of further clockwise rotation, explosive lead member 50, which had followed the axial movement of timing member 47 along right-hand threaded front portion 43 of arming shaft 40, has advanced to the armed position in which explosive passage 52 is aligned with detonator bore 22 of housing member 10 and detonator 24. (See FIGS. 4 and 6). The alignment of explosive passage 52 with detonator bore 22 provides a continuous path which enables communication between detonator 24 located in detonator bore 22 and a booster charge external to the safe and arming mechanism. Explosive passage 52 may be empty or contain energetic material incorporating controlled rate burning or instantaneous detonation or a combination thereof depending upon the intended application of the ordnance item. At this point, transmission of a signal causing detonator 24 to detonate will result in warhead detonation. It is to be noted that in the armed position, explosive lead member 50 is in threadible engagement with right-hand threaded front portion 43 of arming shaft 40. Resistance of explosive lead member 50 to misalignment caused by impact and penetration of hardened targets is enhanced by the inherent strength of threaded design and materials making impact induced dudding due to misalignment or destruction of the mechanism improbable.

This safe and arming mechanism can be test operated and resafed. Test arming requires the withdrawal of gag rod 63 from gag rod bore 21 and the application of correct motor voltage to reversing motor 32 to cause arming alignment to occur. Resafing requires application of a motor voltage to drive explosive lead member 50 back to unthreaded central portion 44 of arming shaft 40. This will result in the convergence of arming block 54 and timing block 47 on arming shaft 40. Insertion of gag rod 63 at this point will pin explosive lead member 50 in place on unthreaded central portion 44 of arming shaft 40. Application of the first motor voltage to reversing motor 32 will now result only timing member 47 and arming block 54 being driven away from unthreaded central portion 44 of arming shaft 40 back to their original positions at the extreme ends of the threaded portions of arming shaft 40. This results in the safe and arming mechanisms' return to a fully safed condition in which it is ready for installation and use in live ordnance.

It is readily seen that first rotatable gear 38 and second rotatable gear 39 are but one means for the transmission of motive power output from reversing motor 32 to arming shaft 40 and that many gear combinations and alternative methods such as planetary gearing, worm gearing, chain and sprocket, belt drive or flexible shafts are available to accomplish the same purpose. It is also clear that while first helical compression spring 49 and second helical compression spring 64, located within spring containment 57, are the obvious means of transmission of compressive forces in this application a large number of options exist including the use of multiple springs, a damping fluid, or a compressible solid to name but a few. Extensive testing and evaluation has resulted in the observation that while arming shaft 40 may be fabricated from any of a number of common metals, such as stainless steel, titanium provides preferred operational characteristics, particularly in relationship to the engagement and disengagement of arming shaft 40 with the threaded components within the safe and arming mechanism.

The requirement that arming shaft 40 rotate in a particular direction before explosive lead member 50 can advance on arming shaft 40 to the armed position represents a mechanical logic check on external control logic 35. Likewise, the initial configuration of the safe and arming mechanism wherein first helical compression spring 49 is fully compressed between timing member 47 and second gear 39 preventing the initial rotation of arming shaft 40 in a direction in which explosive lead member 50 can advance to the armed position represents further mechanical logic within the safe and arming mechanism which checks the operation of external control logic 35 and precludes inadvertent arming through faulty control. In order for the described safe and arming mechanism to arm, interlock ball 62 must be released to move out of arming notch 17 freeing explosive lead member 50 for axial movement, reversing motor 32 must be energized to rotate in a first and then a second particular direction and explosive lead member 50 must receive the impetus to engage arming shaft 40 which must be rotating in a particular cooperating direction. Failure of any of these events to occur in a timely and correct manner will result in the ordnance's failing to arm. This embodiment thus achieves the primary goal of safe and arming technology which is to ensure that ordnance arming can be reliably expected to occur, and, in this case, that the ordnance will survive impact with and penetration of a hardened target in the armed condition, while the pilot and delivering aircraft are protected from the detonation dangers attendant with the premature arming of ordnance to be delivered.

We claim:

1. A safe and arming mechanism comprising:

a cylindrical body having a housing member, an end plate and means for attaching said end plate to said housing member, said housing member defining an arming notch;

a motor mounted in said housing member, said motor energized in response to an externally generated signal;

an arming shaft having a right-hand threaded end, an unthreaded central portion and a left-hand threaded end, said arming shaft mounted for rotation in said body;

means for transmission of motive power output, said means operatively coupling said motor to one threaded end of said arming shaft;

a timing member defining a threaded hole, said timing member in threaded engagement with, restrained from rotation with and constrained to travel axially along said one threaded end of said arming shaft within said arming notch;

first compressible means for transmitting force, said first compressible means interposed between said timing member and said means for transmission of motive power output;

a detonator fixedly located within said housing member to communicate its explosive output to said arming notch, said detonator being responsive to a detonation signal;

an arming block defining a threaded hole, said arming block in threaded engagement with, restrained from rotation with and constrained to travel axially along the end of said arming shaft opposite said one threaded end;

an explosive lead member defining a threaded hole configured for threaded engagement with said one threaded end of said arming shaft, said explosive lead member slidably disposed in said arming notch, restrained from rotation with and constrained to travel axially along said arming shaft and positionable between a safe position, in which said explosive lead member is slidably engaged on and penetrated by said unthreaded central portion of said arming shaft, and an armed position, in which said explosive lead member is in threaded engagement with and is penetrated by said one threaded end of said arming shaft, said explosive lead member further defining an open-ended explosive lead passage one end of which is positionable adjacent said detonator when said explosive lead member is in said armed position;

second compressible means for transmitting force, said second compressible means interposed between said arming block and said explosive lead member, said second compressible means configured to selectively contact said explosive lead member in response to said axial movement of said arming block along said end of said arming shaft opposite said one threaded end; and a mechanical interlock operable within said housing member positionable between a blocking position in which the threadible engagement with and axial travel along said one threaded end of said arming shaft by said explosive lead member is prevented and a free position in which said axial travel of said explosive lead member is unrestrained, said mechanical interlock configured to move to said free position from said blocking position in response to a release signal.

2. A safe and arming mechanism as recited in claim 1 wherein said first compressible means for transmitting force is a first helical compression spring.

3. A safe and arming mechanism as recited in claim 1 wherein said housing member further defines a ball chamber communicating with said arming notch and a gag rod bore communicating with said ball chamber and wherein said mechanical interlock comprises:

an interlock ball retained within said ball chamber and positionable to protrude into said arming notch; and a gag rod slidably disposed within said gag rod bore and positionable between said blocking position, in which said gag rod retains said interlock ball in said protruding position, and said free position, in which said gag rod does not retain said interlock ball in said protruding position.

4. A safe and arming mechanism as recited in claim 1 further comprising means for aligning said end plate with said housing member.

5. A safe and arming mechanism as recited in claim 1 wherein the direction of rotation of said motor is reversible.

6. A safe and arming mechanism as recited in claim 5 wherein:

said motor has an output shaft; and said means for transmission of motive power output comprises a first rotatable gear fixedly mounted on said output shaft and a second rotatable gear fixedly mounted on said one threaded end of said arming shaft, said second rotatable gear meshingly engaging said first rotatable gear.

7. A safe and arming mechanism as recited in claim 1 wherein said second compressible means for transmitting force is a second helical compression spring.

8. A safe and arming mechanism as recited in claim 7 wherein said second compressible means for transmitting force further comprises a containment confining said second helical compression spring under compression.

* * * * *